US006210799B1

(12) United States Patent
Berger et al.

(10) Patent No.: US 6,210,799 B1
(45) Date of Patent: Apr. 3, 2001

(54) INDUSTRIAL YARN PA 6.6 WITH LITTLE COTTON WASTE

(75) Inventors: Luzius Berger, Malters; Klaus Fischer, Luzern, both of (CH); José Luvizotto, Sao Cactano do Sul (BR)

(73) Assignee: Rhodia Filtec AG, Emmenbruecke (CH)

( * ) Notice: Subject to any disclaimer, the term of this patent is extended or adjusted under 35 U.S.C. 154(b) by 0 days.

(21) Appl. No.: 09/509,092

(22) PCT Filed: Sep. 22, 1997

(86) PCT No.: PCT/CH97/00357

§ 371 Date: May 15, 2000

§ 102(e) Date: May 15, 2000

(87) PCT Pub. No.: WO99/15721

PCT Pub. Date: Apr. 1, 1999

(51) Int. Cl.[7] ..... D01F 6/00; D01F 6/90

(52) U.S. Cl. ..... 428/364; 428/395

(58) Field of Search ..... 428/364, 395; 57/288; 528/335

(56) References Cited

U.S. PATENT DOCUMENTS 4,648,240 * 3/1987 Hallsworth et al. ..... 57/288
5,106,946 * 4/1992 Clark, III et al. ..... 528/335
6,023,824 * 2/2000 Fishcher et al. ..... 28/240

* cited by examiner

*Primary Examiner*—N. Edwards
(74) *Attorney, Agent, or Firm*—Michael J. Striker

(57) ABSTRACT

Industrial yarn PA 6.6 comprised of filaments having a global yarn count of at least 900–2100 tex, which is made by submitting wet granulate PA 6.6 to a melt spinning-drawing process, is characterized by a strength of >84 cN/tex for less than 1.5 linters/1 km. Said yarn is used preferably in the production of cord fabric with a rubber ply.

3 Claims, 1 Drawing Sheet

INDUSTRIAL YARN PA 6.6 WITH LITTLE COTTON WASTE

Figure 1:
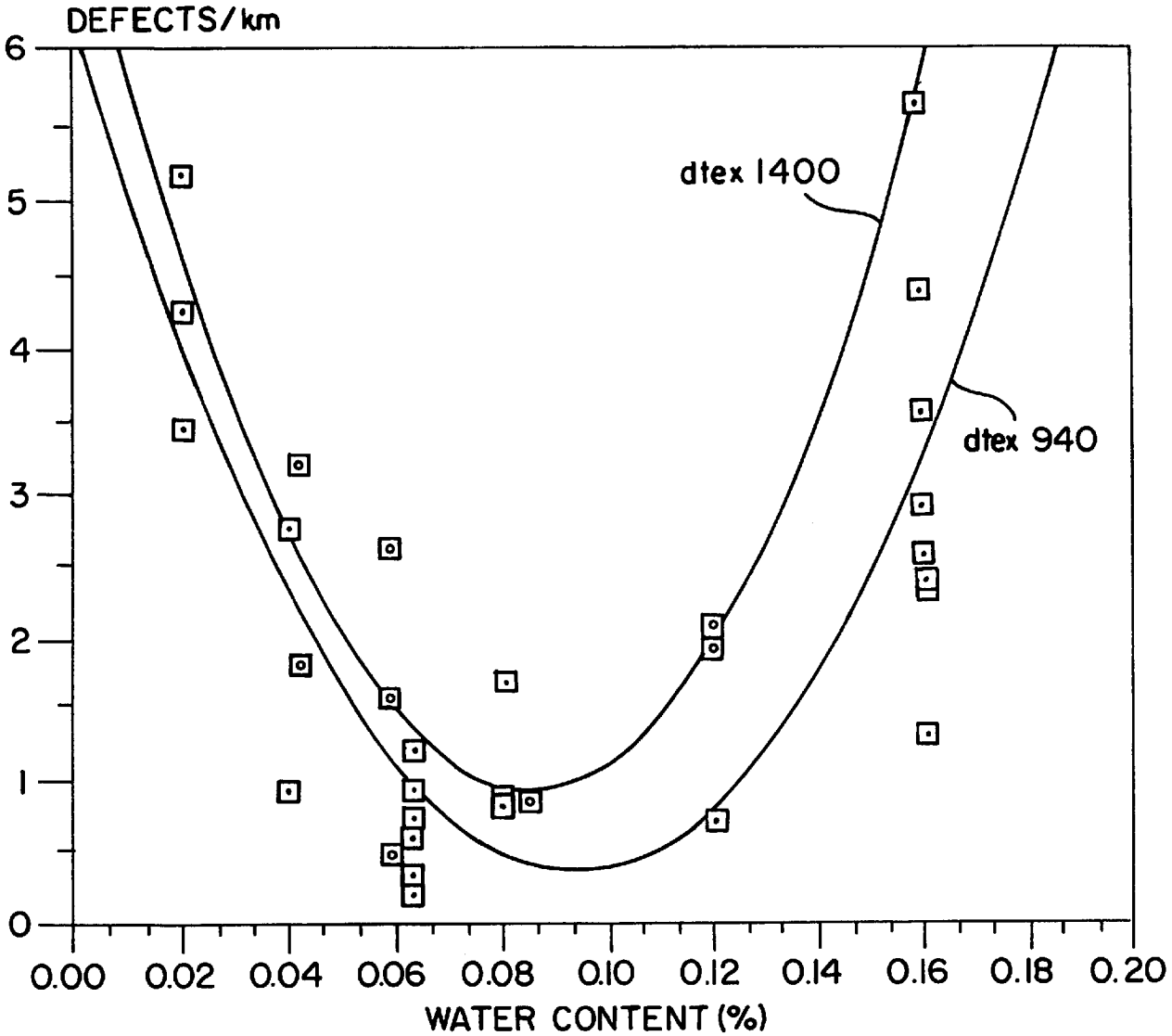

The present invention relates to a PA 6,6 industrial yarn consisting of filaments having a total linear density of 900 to 2100 dtex and produced by melt-spinning and drawing of polyamide-6,6 having a pellet viscosity RV >75 at a winding speed $v_{sp}$ which has to meet the following conditions:

$$v_{sp}=(Ft_o/Ft_x)^3 * v_{spo}, \text{ where Ft=tenacity, } Ft_o=84\ cN/tex, Ft_x=\text{eff Ft in cN/tex and } v_{spo}=2750 \text{ m/min} \quad (1)$$

in the presence of water, and also to a process for producing a low-defect industrial yarn.

As well as its serimetry, its level of defects is a significant quality factor of an industrial yarn. At winding speeds of more than 2750 m/min, polyamide industrial yarns generally have an excessively high defect level of the order of more than 1.5 defects per km. To reduce defects, it was hitherto necessary to reduce the spinning speed, which entails reduced productivity. It has now been found that the defect level depends not only on the spinning and winding speed but also, strongly, on the moisture content of the polyamide polymer fed into the extruder.

It is known to moisten PA 66 polymer ahead of the extruder or in the melt. In each case the purpose is to ensure consistent melt quality. The moisture is added in controlled fashion via moist $N_2$ or as direct metered addition of water, for which the melt pressure ahead of the spinning pump can be utilized as control variable.

EP-B-0 092 898 discloses controlling physical properties of meltable polyamides by depolymerization by means of moisture. In said reference, water is added to keep the viscosity constant. The object is considered to be to produce a polymer melt having constant physical properties.

The present invention has as its object to provide a PA 66 industrial yarns having a tenacity of at least 84 cN/tex, very rapid processing and a minimum of defects.

This object is achieved according to the invention when the PA 6,6 filament combines a tenacity of >84 cN/tex and with less than 1.5 defects/km.

In a variant featuring a pellet viscosity RV >90, a moisture content >0.06% and a tenacity $Ft_x$>90 cN/tex, it is possible to obtain at a spinning speed $v_{spo}$ greater than the spinning speed calculated by the formula (1) an industrial yarn having a high linear density and a surprisingly low number of defects conforming to the following formula:

$$\text{defects } F1<(Ft_x/Ft_o)^3 * v_{spx}/v_{spo} * Tt_x/Tt_o, \text{ where} \quad (2)$$

$Tt_o$ is a linear density of 940 [lacuna] and $Tt_x$ is the linear density at the winding speed $v_{spx}$.

The advantage is a low defect level which, if dry PA 66 polymer pellets are used, can otherwise only be achieved at low spinning-drawing speeds.

It is particularly advantageous for the water content of the polymer pellets ahead of the extruder to be in the range of 0.04–0.14% by weight, especially 0.06–0.12% by weight.

The invention will now be more particularly described with reference to an example.

A polyamide-6,6 polymer post-condensed to a relative viscosity (RV) of about 93 was admixed ahead of the extruder with varying quantities of water so that the resulting total moisture content of the polymer varies between 0.16 and 0.02%. The winding speed was 2750 m/min in all runs. The throughput was a constant 46 kg/h. The tenacity Ft was likewise constant at 85 cN/tex.

The relative pellet viscosity was measured in 90% strength formic acid using ASTM method D 789-81.

Defects were measured using a Warpstop 450 from Protechna, FRG. Each test was carried out with 24 packages.

The results are depicted in FIG. 1. FIG. 1 shows the plot of the number of defects against the water content of the PA 6,6 polymer pellets ahead of melting. Curve 1 demonstrates the dependence for a linear density of 940 dtex with a pellet RV of 93 and a throughput of 46 kg/h; curve 2 demonstrates the defect trajectory under otherwise identical conditions for a linear density of 1400 dtex, whose curve trajectory is broadly similar.

As is further evident from FIG. 1, the defect level initially decreases dramatically with increasing water content in the feed polymer. At a water content of 0.02%, the moisture content ex dryer, a winding speed of 2750 m/min produces defect numbers of around 5 defects per kilometer. At a water content of about 0.09%, surprisingly, minimum values are achieved in relation to defects. As the water content continues to increase, defects increase again sharply.

Further examples are recited in the following Table I.

TABLE I

| No. | Linear density [dtex] | Winding speed Vsp [m/min] | Tenacity Ft [cN/tex] | Number of defects/km | $H_2O$ [%] |
|---|---|---|---|---|---|
| 1 | 1880 | 2260 | 92.6 | 1.7 | 0.08 |
| 2 | 1400 | 2040 | 94.2 | 1.6 | 0.08 |
| 3 | 2100 | 2050 | 92.7 | 2.0 | 0.08 |
| 4 | 1400 | 2750 | 84 | 3.5* | 0.02 |
| 5 | 1400 | 2750 | 84 | 0.7 | 0.07 |

*without addition of water

The yarns recited in Examples 1–3 are known as super high tenacity (SHT) yarns, whereas the yarns recited in Examples 4 and 5 are known as HT yarns. In each case, a polymer having a relative pellet viscosity RV 93 was spun.

It is evident that less than 1.5 defects per km are achieved at a water content of 0.04 to 0.14 and less than 1 defect per km is achieved at a water content of 0.08 to 0.11. The polyamide yarn of the invention has half the defect level of the prior art. The yarn is preferably suitable for producing cord fabrics for use in rubber, for example for transport belts, drive belts and automobile tyres.

What is claimed is:

1. A PA 6,6 industrial yarn consisting of filaments having a total linear density of 900 to 2100 dtex and produced by melt-spinning and drawing of polyamide-6,6 having a pellet viscosity RV >75 at a winding speed $v_{sp}$ which has to meet the following conditions:

$$v_{sp}=(Ft_o/Ft_x)^3 * v_{spo}, \text{ where Ft=tenacity, } Ft_o=84 \text{ cN/tex, } Ft_x=\text{eff Ft in cN/tex and } v_{spo}=2750 \text{ m/min} \quad (1)$$

in the presence of water, characterized in that the PA 66 filament yarn combines a tenacity of >84 cN/tex and with less than 1.5 defects/km.

2. A PA 6,6 industrial yarn according to claim 1, characterized in that the number of defects at a pellet viscosity RV >90, a moisture content >0.06% and a tenacity Ft >90 cN/tex conforms to the following formula:

$$\text{defects } F1<(Ft_x/Ft_o)^3 * v_{spx}/v_{spo} * Tt_x/Tt_o,$$

where (2) $Tt_o$ is a linear density of 940 dtx and $Tt_x$ is the linear density at the winding speed $v_{spx}$.

3. A process for producing PA 6,6 industrial yarn according to claim 1 having a total linear density of 900 to 2100 dtex by melt-spinning polyamide-6,6 having a relative pellet viscosity (RV) of at least 75 in the presence of water, characterized in that the water content of the PA 6,6 polymer after addition of the water ahead of the extruder is 0.04–0.14% by weight.

* * * * *